US007157996B2

(12) United States Patent
Enomoto et al.

(10) Patent No.: US 7,157,996 B2
(45) Date of Patent: Jan. 2, 2007

(54) ELECTROMAGNETIC SWITCHING DEVICE

(75) Inventors: Hideki Enomoto, Ikoma (JP); Riichi Uotome, Katano (JP); Kouji Yokoyama, Osaka (JP); Katsuyoshi Kamioka, Tsu (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/535,337

(22) PCT Filed: Jul. 1, 2004

(86) PCT No.: PCT/JP2004/009343

§ 371 (c)(1),
(2), (4) Date: May 18, 2005

(87) PCT Pub. No.: WO2005/004184

PCT Pub. Date: Jan. 13, 2005

(65) Prior Publication Data

US 2006/0050466 A1 Mar. 9, 2006

(30) Foreign Application Priority Data

Jul. 2, 2003 (JP) ..... 2003-270346

(51) Int. Cl.
*H01H 67/02* (2006.01)

(52) U.S. Cl. ..... 335/132; 335/126; 335/202

(58) Field of Classification Search ..... 335/126, 335/131, 78–83

See application file for complete search history.

(56) References Cited

U.S. PATENT DOCUMENTS 2,433,703 A * 12/1947 Mekelburg ..... 335/261
3,571,770 A * 3/1971 Dew ..... 335/256
5,389,905 A 2/1995 Shibata et al.

FOREIGN PATENT DOCUMENTS

| | | |
|---|---|---|
| JP | 49-088265 | 11/1947 |
| JP | 49-149966 | 4/1948 |
| JP | 48-089361 | 11/1973 |
| JP | 56-017877 | 4/1981 |
| JP | 58-088752 | 6/1983 |
| JP | 1-199033 | 8/1989 |

(Continued)

OTHER PUBLICATIONS

English Language Abstract of JP 2002-042628.

(Continued)

*Primary Examiner*—Elvin Enad
*Assistant Examiner*—Bernard Rojas
(74) *Attorney, Agent, or Firm*—Greenblum & Bernstein, P.L.C.

(57) ABSTRACT

In the electromagnetic switching device, it is possible to miniaturize and have low costs, have quiet operation noise, and also quickly extinguish the arc. The electromagnetic switching device has an electromagnetic actuator with a movable iron core, a pair of fixed terminals that respectively have a fixed contact point, a movable contact that has movable contact points on the right and left ends, a shaft, and an enclosing component that holds the movable contact points and the fixed contact points. The pair of movable contact points respectively contact with and detach from the pair of fixed contact points, and the pair of fixed contact points respectively conduct each other and are insulated again through the shaft by moving the movable iron core along the axis using the electric magnetic actuator. A quasi-hermetically sealed space, which is the extinguishing space, is formed by the enclosing component and a first yoke. A potting compound is charged, into the space between a body and the quasi hermitically sealed space.

17 Claims, 18 Drawing Sheets

FOREIGN PATENT DOCUMENTS

| | | |
|---|---|---|
| JP | 2-115979 | 9/1990 |
| JP | 5-182573 | 7/1993 |
| JP | 5-205594 | 8/1993 |
| JP | 5-298993 | 11/1993 |
| JP | 2002-042626 | 2/2002 |
| JP | 2003-100189 | 4/2003 |

OTHER PUBLICATIONS

English Language Abstract of JP 5-205594.
English Language Abstract of JP 2003-100189.
English Language Abstract of JP 58-088752.
English Language Abstract of JP 5-182573.
English Language Abstract of JP 49-088265.
English Language Abstract of JP 56-017877.
English Language Abstract of JP 49-149966.
English Language Abstract of JP 48-089361.
English Language Abstract of JP 5-298993.
English Language Abstract of JP 2-115979.
English Language Abstract of JP 1-199033.

* cited by examiner

ELECTROMAGNETIC SWITCHING DEVICE

FIELD OF THE INVENTION

The present invention relates to an electromagnetic switching device to make or break a circuit in an electric drive mobile object e.g.

BACKGROUND OF THE INVENTION

Conventionally, in electromagnetic switching devices, some of them have been used for the purpose of making and breaking an electric power circuit of a vehicle, using the format whereby the contact mechanism is operated by opening and closing with an electromagnetic actuator. As examples of these types of electromagnetic switching devices, the ones shown in FIGS. 19, 20 and 21 are well known. These types of examples include the Japanese Patent Laid-Open Publication No. 2002-42628.

This electromagnetic switching device consists of a body 11 made of resin (plastic), an electromagnetic actuator 2, a pair of fixed terminals 3, a movable contact 4, a shaft 5, etc. as shown in the Figure.

The body 11 is formed into a box shape that is cut in half, and the main body of the electromagnetic switching device is placed inside. The body 11 has mountings 13 on the right and left sides (the same as the right and left sides in the Figure) to fix the electromagnetic switching device to the external attaching part. Also, the body 11 has a lead-out groove (not shown in the Figure) to expose the terminal area 31 of the fixed terminals 3 from the inside to the outside in order to connect it to an external circuit.

The electromagnetic actuator 2 consists of a solenoid coil, top and bottom yokes (the same top and bottom as in the Figure), a movable iron core, etc. The solenoid coil 21 consists of a cylindrical bobbin 21*a*, which has flanges on the top and bottom, with the conducting wire wound around it, and both ends of the conducting wire are led to the outside of the body 11 (not shown in the Figure). A first yoke 23 is placed from the middle of the inner circumference surface to the upper surface of the solenoid coil 21, and a second yoke 24 is placed from the lower part of the inner circumference surface to the bottom surface and the outer circumference surface of the solenoid coil 21, and these, the first yoke 23 and the second yoke 24, form the magnetic gap with the magnetic poles facing each other inside the solenoid coil as well as the magnetic path.

A movable iron core 22 has a part of itself intervening in the magnetic gap mentioned above, and has the rest of itself in the internal cylindrical part of the second yoke 24. Also, the movable iron core 22 is biased to the direction such that the magnetic gap can be made larger (to the bottom of the Figure) by a coil spring 22*a*. Therefore, when the solenoid coil 21 is excited, the movable iron core 22 moves up in order to lessen the magnetic gap, and when the excitation is stopped, it moves down by the coil spring 22*a*.

The fixed terminal 3 is built with the rectangular shaped conductive plate bent twice in a same direction and both ends turned in a same direction. The fixed terminal 3 has the terminal area 31 outside of the body 11 and has a fixed contact point 32 facing downward inside the body 11 as well.

The movable contact 4 is built to have movable contact points 41 each respectively facing opposite to said fixed contact points 32 on both ends of the rectangular shaped long conductive plate with the center part bent downward, and it is fixed under a retentive part 51 that is formed on the upper part of the shaft 5. The movable contact 4 is pushed up against the headliner of the retentive part 51 by contact pressure springs 41*a* under the retentive part 51.

The shaft 5 has the bottom end of the connecting axis that extends downward from said retentive part 51 and is fixed into the movable iron core 22, and is placed on the central axis of the electromagnetic actuator 2. The shaft 5 is movable up and down within a specified range inside the electromagnetic actuator 2. The lowest limit of the movement is the point where the bump of the diameter expansion part of the shaft 5 contacts with the insertion hole on the central axis of the first yoke 23, and the cushioning component 53*a* is placed on the contact point. Additionally, the upper limit of the movement is the point where the upper end of the movable iron core 22 contacts with the lower end of the first yoke 23.

On the lateral side that is outside the body 11 and that the fixed contact points 32 and the movable contact points 41 contact and detach, a yoke 64 that forms the magnetic path and a pair of permanent magnets 65 for generating the magnetic field are placed. The permanent magnets 65 are placed with the magnetic poles facing each other in order to quickly extinguish an arc, which is generated when the fixed contact points 32 and the movable contact points 41 contact and detach, by the magnetic field of the permanent magnets.

When the electromagnetic switching device with the mechanism described above is brought into action and the movable iron core 22 is moved up and down by the electromagnetic actuator 2, the pair of movable contact points 41 of the movable contact 4 each respectively contact with and detach from the pair of fixed contact points 32 through the shaft 5 that moves up and down. Because of this, the circuit between the terminal areas 31 on the pair of fixed terminals 3 is electrically opened and closed through the movable contact 4.

However, because the existing electromagnetic switching devices mentioned above have space (extinguishing space SP) to scatter the energy of the arc by stretching the arc spatially for the purpose of quickly extinguishing the arc generated at the time of opening and closing of the circuit, there is a problem that it is difficult to miniaturize the electromagnetic switching devices. Because the space around the solenoid coil 21 is to be used as the space for extinguishing the arc, there is a possibility of the arc approaching the winding wire of the solenoid coil 21, and it is preferable to avoid this type of mechanism in order to maintain the insulation performance between the circuit side opened and closed (the primary side) and the controlling side of the electromagnetic switching device (the secondary side).

In addition, the arc is occasionally brought into contact with the resin of the body 11 to generate an extinguishing gas, and in this case, because it is necessary to enclose the extinguishing space with the resinous component that generates the extinguishing gas, there is a limit in miniaturizing the electromagnetic switching device. Also, when the electromagnetic switching device is used for electric vehicles, it is preferred to decrease further the operating noise of the electromagnetic switching device, etc. in order to keep the environment inside the vehicles preferable. This is because the motor that directly generates turning force is used as the drive source and the drive source is quiet unlike the existing petrol engine, etc. that uses explosive burnings as the drive force.

This invention aims at providing an electromagnetic switching device that can be miniaturized, can be made at low cost and is quiet, as well as being able to extinguish the arc quickly.

DISCLOSURE OF THE INVENTION

To achieve the purpose mentioned above, the electromagnetic switching device according to the present invention comprises: an electromagnetic actuator which has a solenoid coil wound around one axis and having hollow part on the axis, a movable iron core placed movably along said axis in said hollowing part, a first yoke placed on one of the ends of said solenoid coil, facing to one of the ends of said axis, and having an insertion hole on said axis, and a second yoke placed on the other end of said solenoid coil, facing to the other end of said axis; a pair of fixed terminals respectively having a fixed contact on one of the ends of said axis as well as the terminal area, which connects to the external circuit, on the other end of said axis; a movable contact having a pair of movable contact points, which respectively contact with and detach from said fixed contact points, on both ends; a shaft having a connecting axis which is fixed to a retentive part holding said movable contact, extends from this retentive part to the other end of said axis, is inserted into the insertion hole of said first yoke, and is fixed to said movable iron core; and an enclosing component, which contains said movable contact points and said fixed contact points.

In the electromagnetic switching device of this invention, by moving said movable iron core along said axis using said electromagnetic actuator, the pair of said movable contact points respectively contact with and detach from the pair of said fixed contact points through said shaft, and the enclosing component is formed into a box shape with an opening on the other side of said axis, and each of the fixed contact points sides of the pair of said fixed terminals is inserted from the bottom part of the enclosing component and is fixed. A quasi-hermetically sealed space is formed by the enclosing component and at least said first yoke, and said movable contact points and said fixed contact points are placed in the quasi-hermetically sealed space.

With this type of mechanism, because the quasi-hermetically sealed space is formed by the enclosing component and at least the first yoke, and the movable contact points and the fixed contact points are placed in the quasi-hermetically sealed space, it is possible to miniaturize the extinguishing space and to maintain the extinction performance. Thus, it becomes possible to miniaturize the electromagnetic switching device. In other words, it is possible to increase the capability to cool off the arc (to absorb the energy) because metals have good heat conductance compared to molding materials (resin). In this regard, because the first yoke made of metals is used as a constructional component for the quasi-hermetically sealed space, the extinction performance improves and rapid blocking of the contact points becomes possible. Also, it is possible to share the components of the electromagnetic switching device and to miniaturize, thereby reducing the cost by reducing the number of components of the electromagnetic switching device. Because extinguishing space is constituted within the quasi-hermetically sealed space, the arc does not leak to the outside of this space or damage the solenoid coil of the electromagnetic switching device, and it is possible to maintain the insulation performance between the circuit side that is opened and closed (the primary side) and the controlling side of the electromagnetic switching device (the secondary side.)

In the improved invention described above, it is preferable that this invention has a body that holds the main body of the electromagnetic switching device with said terminal area projected outward, and that the space between said body and said quasi-hermetically sealed space is filled with a potting compound. With this type of mechanism, because the potting compound is charged into the space between the body and the quasi-hermetically sealed space, it is possible to quickly cool down the constructional components of the quasi-hermitically sealed space (the enclosing component and at least the first yoke) that are heated by the arc generated between the contact points. This can be done by using a compound that has good heat conductance as a potting compound. Therefore, it is possible to block the arc by quickly absorbing the heat energy of the arc. Also, because the potting compound restrains the propagation of the vibration that occurs from the inside of the main body of the electromagnetic switching device to the body, a silencing effect can be obtained. By using the potting compound, a covering component is not needed and the body can be built with only one component. This enables the lowering of costs.

In the improved invention described above, it is preferable that the distance between an inside wall of said enclosing component and said movable contact is narrow at the part that is near said shaft, and is wider at the part that is far from said shaft. With this type of mechanism, because the distance between the inside wall of the enclosing component and the movable contact is narrow at the part that is near the shaft and is wider at the part that is far from the shaft, it is possible to restrain the rotational position change of the movable contact caused by the spinning of the shaft that fixes the center part of the movable contact. Thus, the contact position of the movable contact points against the fixed contact points can be stable and the current control by the electromagnetic switching device can be performed more stably.

In the improved invention described above, it is preferable that this invention has a recess, which has an insertion hole on the other end of said axis and is fixed at the bottom part of said enclosing component, on the bottom part, that a flange that rubs the inner surface of said recess in the direction of said axis is formed on the part of one of the ends of said shaft, and that the insertion hole is made on the flange as well as the valve that opens and closes the insertion hole. It is also preferable that said insertion hole is covered by inserting one of the ends of the shaft including said flange in said insertion hole, and said recess is filled with gas, fluids or particles that become resistant to the movement of said shaft along said axis.

In the improved invention described above, it is preferable that this invention has a mass body that vibrates along said axis by deforming elastically in at least one moving part in order to restrain the movement of the moving part that moves accompanying the movement of said movable iron core.

In the improved invention described above, it is preferable that this invention has a gap quasi-connected on the respective facing surfaces of said first yoke and said movable iron core.

In the improved invention described above, it is preferable that this invention has an enclosure with fluids inside at the position where at least one of the following collides: the movable iron core, the shaft, and the movable contact.

With this type of mechanism, it is possible to perform a suitable braking for the discontinuation of the movement of the moving parts that move accompanying the excitation and non-excitation of the electromagnetic actuator, and is also possible to obtain an electromagnetic switching device that whose operating noise is quiet.

In the improved invention described above, it is preferable that this invention has a body that holds the main body of the electromagnetic switching device with said terminal area projected outward, and that said body has mountings which have insertion holes to insert the fixing component used to attach the body to the external mountings. It is also preferable that pipes made of high damping steel are inserted into said insertion holes and, with the pipes intervening, said body is fixed to the external mountings by inserting the fixing component into the insertion holes and the pipes on said mountings.

In the improved invention described above, it is preferable that this invention has a body that holds the main body of the electromagnetic switching device with said terminal area projected outward, and that said body has mountings which have insertion holes to insert the fixing component used to attach the body to the external mountings. It is also preferable that a flexible ring-shaped component that encloses the magnetic fluids, MR fluid or ER fluid is placed on the attaching side of the mountings, and with the ring-shaped component intervening, that said body is fixed to the external mountings by inserting the fixing component into the insertion holes and the pipes on said mountings.

With this type of mechanism, it is possible to restrain the vibration of the electromagnetic switching device from transmitting to outside and to make an operating noise quiet.

PREFFERED EMBODIMENT OF THE INVENTION

The electromagnetic switching devices concerning the embodiments of this invention are described referring to the Figures as follows. The directions, top and bottom, right and left, and front and back, in the Figures are referred to accordingly. In addition, the electromagnetic switching devices of this invention can be used in all the mounting directions.

Embodiment 1

Figure 1:
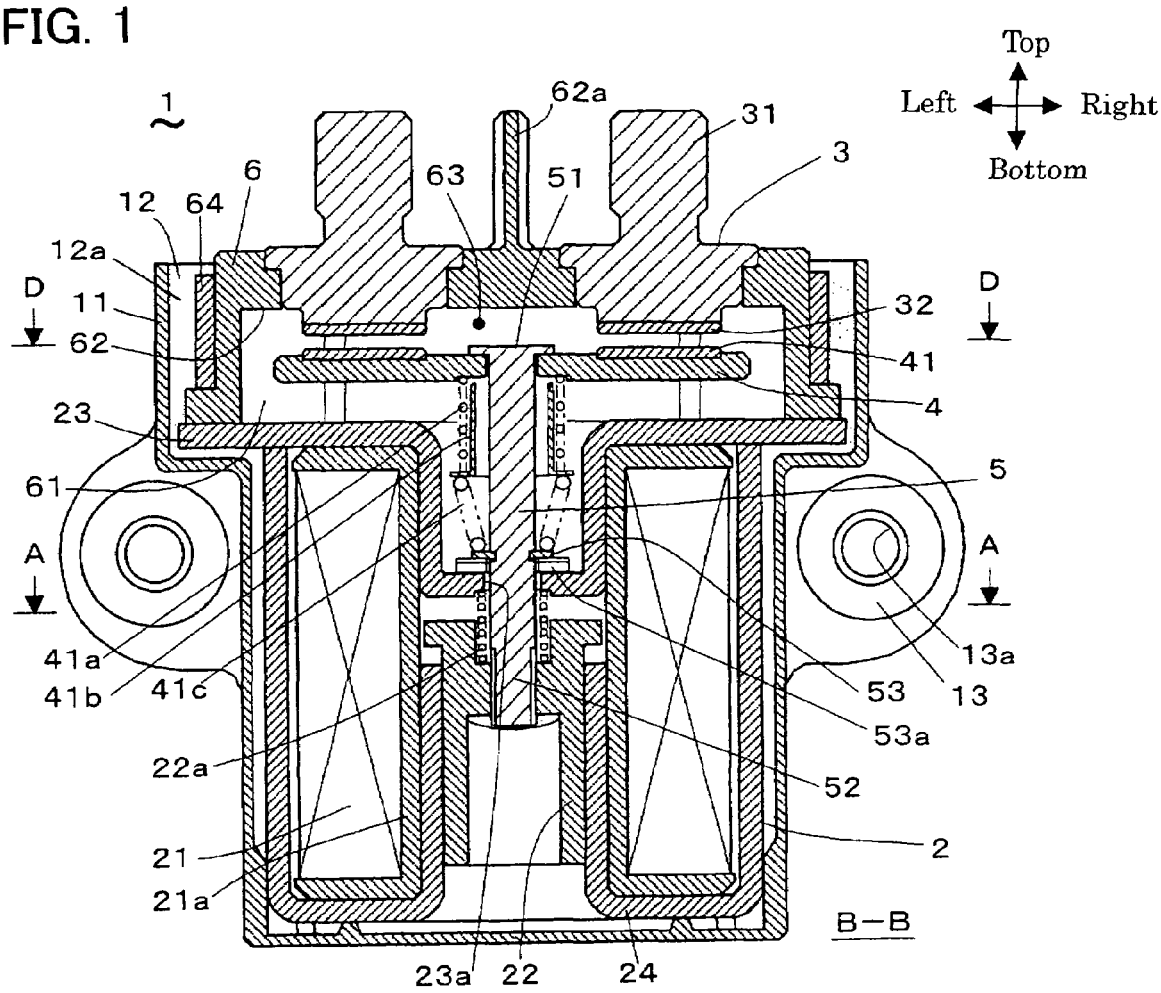
FIG. 1 Cross-section view on the plain surface indicating directions, right, left, top and bottom, of an electromagnetic switching device concerning Embodiment 1 of this invention FIG. 2 Top view of the electromagnetic switching device without a potting process FIG. 3 Cross-section view of line C—C of FIG. 2

FIGS. 1 to 8 show the electromagnetic switching device of Embodiment 1. FIG. 1 is mainly referred to and the other figures are referred to accordingly as below. The electromagnetic switching device 1, as shown in FIG. 1, has the electromagnetic actuator 2 that has the movable iron core 22, the pair of fixed terminals 3 that respectively has the fixed contact points 32, the movable contact 4 that has the movable contact points 41 on the right and left ends, the shaft 5, and the enclosing component 6 that holds the movable contact points 41 and the fixed contact points 32. The pair of movable contact points 41 respectively contact with and detach from the pair of fixed contact points 32, and the pair of fixed contact points 32 are each respectively conducted by each other or insulated again through the shaft 5 by the electromagnetic actuator 2 moving the movable iron core 22 along the axis (hereafter referred to as the direction of up and down or the axis that is placed vertically). The mechanism and the assembly of each component are sequentially described, and the movement of the electromagnetic switching device 1 is described subsequently.

The electromagnetic actuator 2 consists of the solenoid coil 21, the first and second yokes 23 and 24 that are placed one above the other, the movable iron core 22, etc. The solenoid coil 21 consists of the hollow bobbin 21*a*, which has the flanges one above the other, with the conducting wire wound around it, and both ends of the conducting wire are led to the outside of the body 11. The first yoke 23 is placed from the middle of the inner circumference surface to the upper surface of the solenoid coil 21, the second yoke 24 is placed from the lower part of the inner circumference surface to the lower surface and the outer circumference surface of the solenoid coil 21, and these, the first yoke 23 and the second yoke 24, form the magnetic gap that has the magnetic poles facing each other inside the solenoid coil as well as the magnetic path. (Refer to FIGS. 5 and 4 regarding the shape of the first and second yokes.)

The movable iron core 22 has a part of itself intervening in the magnetic gap mentioned above and has the rest of itself placed movably up and down in the internal tube component of the second yoke 24. Also, the movable iron core 22 is biased to the direction such that the magnetic gap becomes larger (to the bottom) by the action of the coil spring. Therefore, when the solenoid coil 21 is excited, the movable iron core 22 moves up in order to lessen the magnetic gap, and when the excitation is stopped, it moves down by the action of the coil spring 22*a*.

The fixed terminal 3 consists of a pair of conductors having fixed contact points 32 on the lower end and the terminal area 31, which connects to the external circuit, on the upper end, and are placed on the upper part of the enclosing component 6 separately to the right and left sides. The groove, for example, is formed on the terminal area 31 so that the external terminal can be fixed with screw nuts.

The movable contact 4 is built to have the movable contact points 41 facing opposite to said fixed contact points 32 each respectively on the both right and left ends of the rectangular shaped long conductive plate so that they contact and detach, and the middle part of it is fixed under the retentive part 51 that is formed on the upper part of shaft 5. In other words, the upper surface of the movable contact 4 is pushed by the guard part of the retentive part 51 and at the same time the bottom surface is pushed up by the contact pressure springs 41*a* and 41*b*.

The shaft 5 is a rhabdom that is movable up and down within a specified range along the central axis inside the electromagnetic actuator 2. The lower end of the connecting axis 52 that extends downward from the retentive part 51 on the upper end is fixed into the movable iron core 22, and the shaft 5 is placed on the central axis of the electromagnetic actuator 2. The lowest limit of the movement of the shaft 5 is the point where the diameter expansion part created by a stopper 53 such as the C-shaped ring, for example, and placed at the middle of the connecting axis of the shaft 5 collides with the insertion hole 23*a* on the central axis of the first yoke 23. The cushioning component 53*a* is placed on the collision point. Also, the upper limit of the movement is the point where the upper end of the movable iron core 22 contacts with the lower end of the first yoke 23.

The body 11 is made of a resin molding that has an opening on the upper side, and the main body of the electromagnetic switching device is placed inside through the opening. The body 11 has the mountings 13 on the both right and left sides in order to be attached to the attaching parts of other devices for the use of the electromagnetic switching device 1. The body 11 is fixed to the external attaching part with screw bolts, nuts, etc. using the insertion holes 13*a* that are formed on the mountings 13.

The enclosing component 6 holds the movable contact points 41 and the fixed contact points 32. The enclosing component 6 is formed into a box shape with an opening 61 on the lower side, and the fixed contact points 32 side of the fixed terminal 3 is fixed by being inserted into the insertion holes from the outside to the inside on the right and left sides of the bottom part 62 (in the layout of the Figure, it is reversed and the bottom is up.) The enclosing component 6, for example, is made of insulating materials such as mold resin and ceramics. On the outside wall of the bottom part 62 of the enclosing component 6, the dividing wall 62*a* is built to separate the terminal area 31 of the right side of the fixed terminal 3 from the left side of the fixed terminal 3 spatially.

Figure 2:
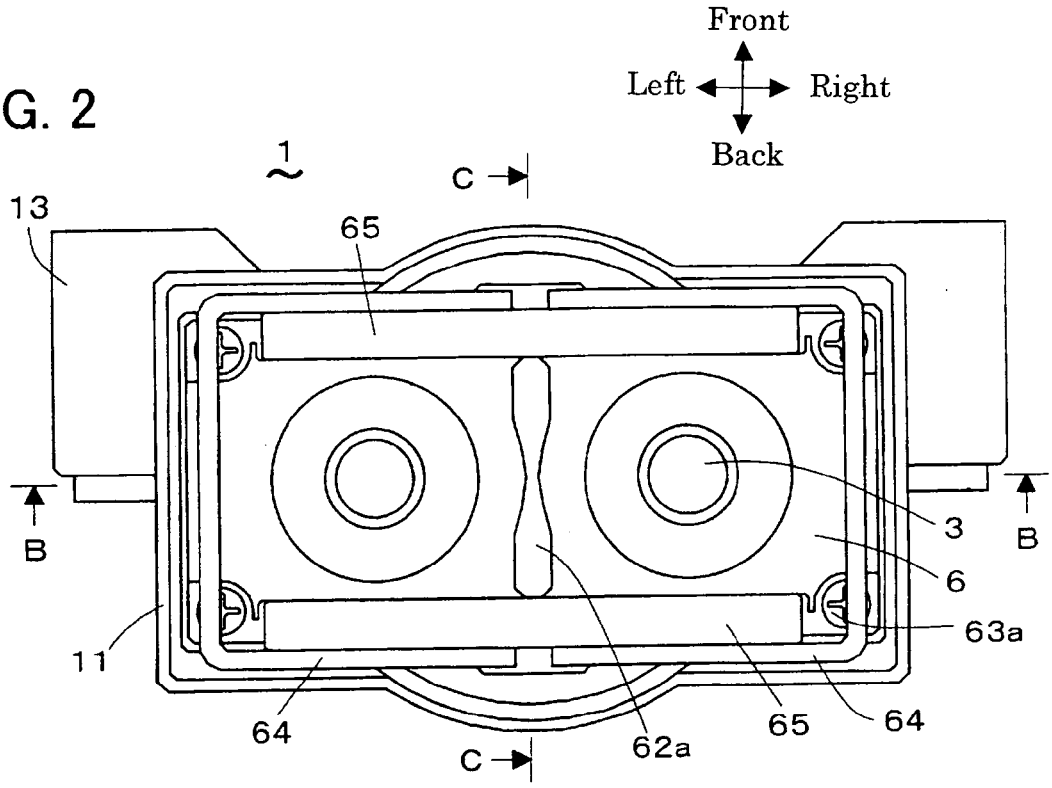

The enclosing component 6 has the guard part facing outward around the opening 61 and is fixed on the upper surface of the first yoke 23 with the screws 63*a* through the attaching holes at the four corners of the guard part (refer to FIG. 5) as shown in FIG. 2. In this state, a quasi-hermetically sealed space 63 is formed by the enclosing component 6 and the first yoke 23. In the quasi-hermetically sealed space 63, the fixed contact points 32 and the movable contact points 41, in other words, the movable contact 4 which has the movable contact points 41, the shaft 5 which has the movable contact 4 and moves it up and down, and the accessories such as the contact pressure springs 41*a* and 41*b* are placed. In this quasi-hermetically sealed space 63, the fixed contact points 32 and the movable contact points 41 contact with and detach from each other and additionally the arc generated by this contact and detachment is extinguished.

Figure 3:
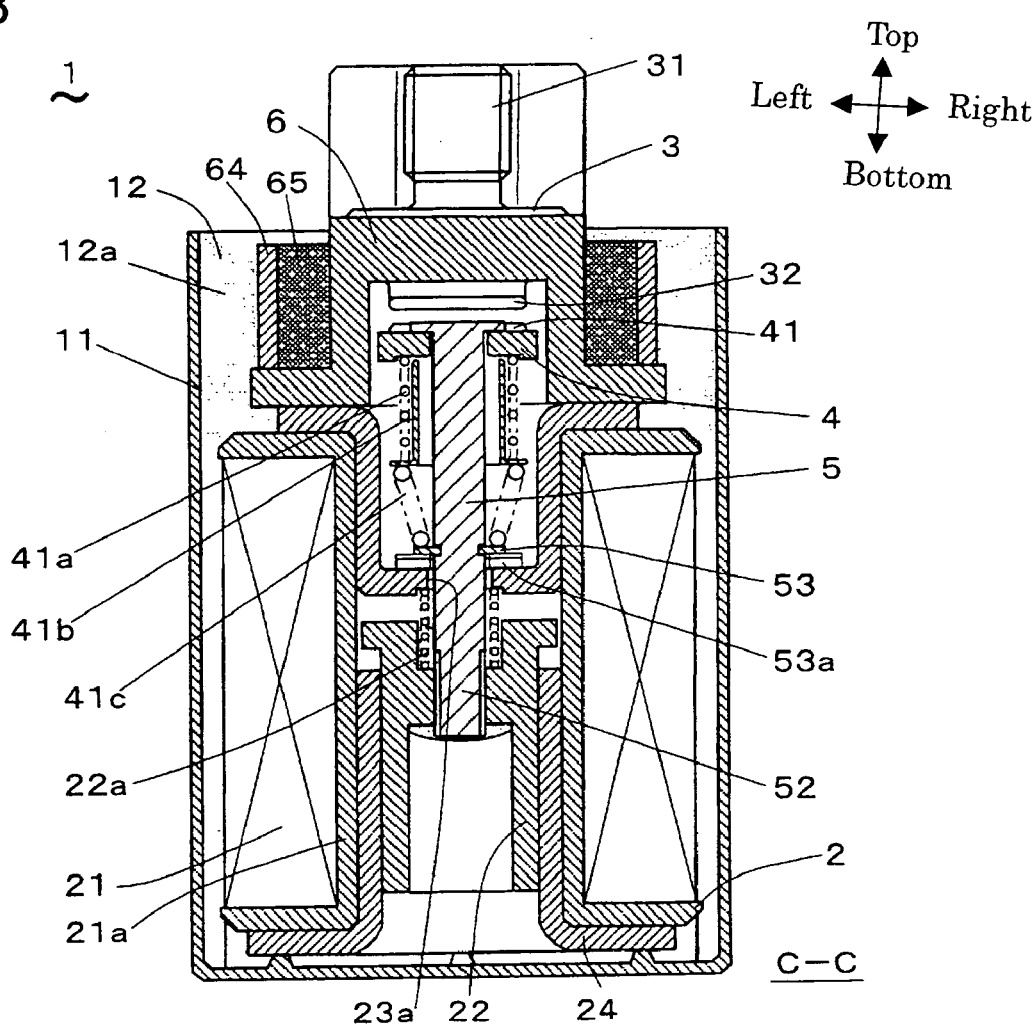
Figure 4:
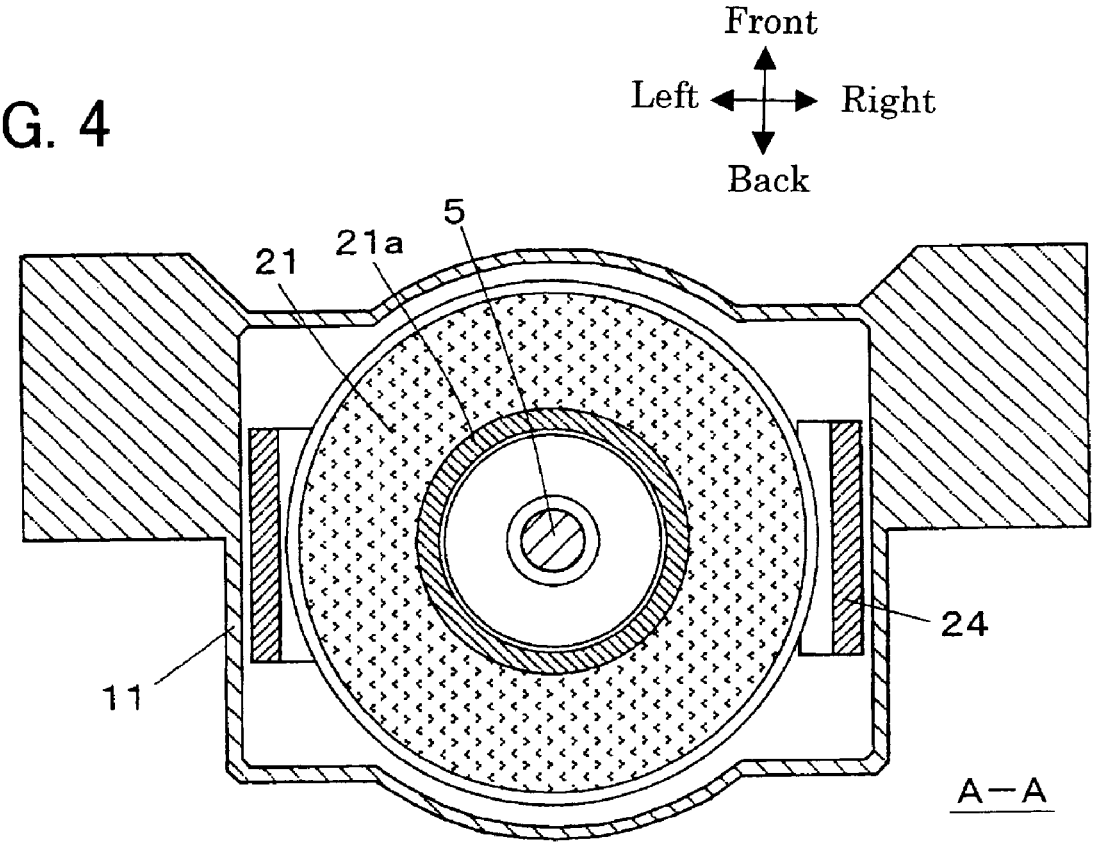
FIG. 4 Cross-section view of line A—A of FIG. 1

Around the enclosing component 6, the pair of permanent magnets 65 are fixed by the yoke 64 for forming the magnetic path, and are placed so that the enclosing component 6 is put between them as shown in FIGS. 2 and 3. These permanent magnets 65 are placed with the magnetic poles facing each other in order to quickly extinguish the arc, which is generated when the fixed contact points 32 and the movable contact points 41 contact and detach, by the magnetic field of the permanent magnet.

Figure 5:
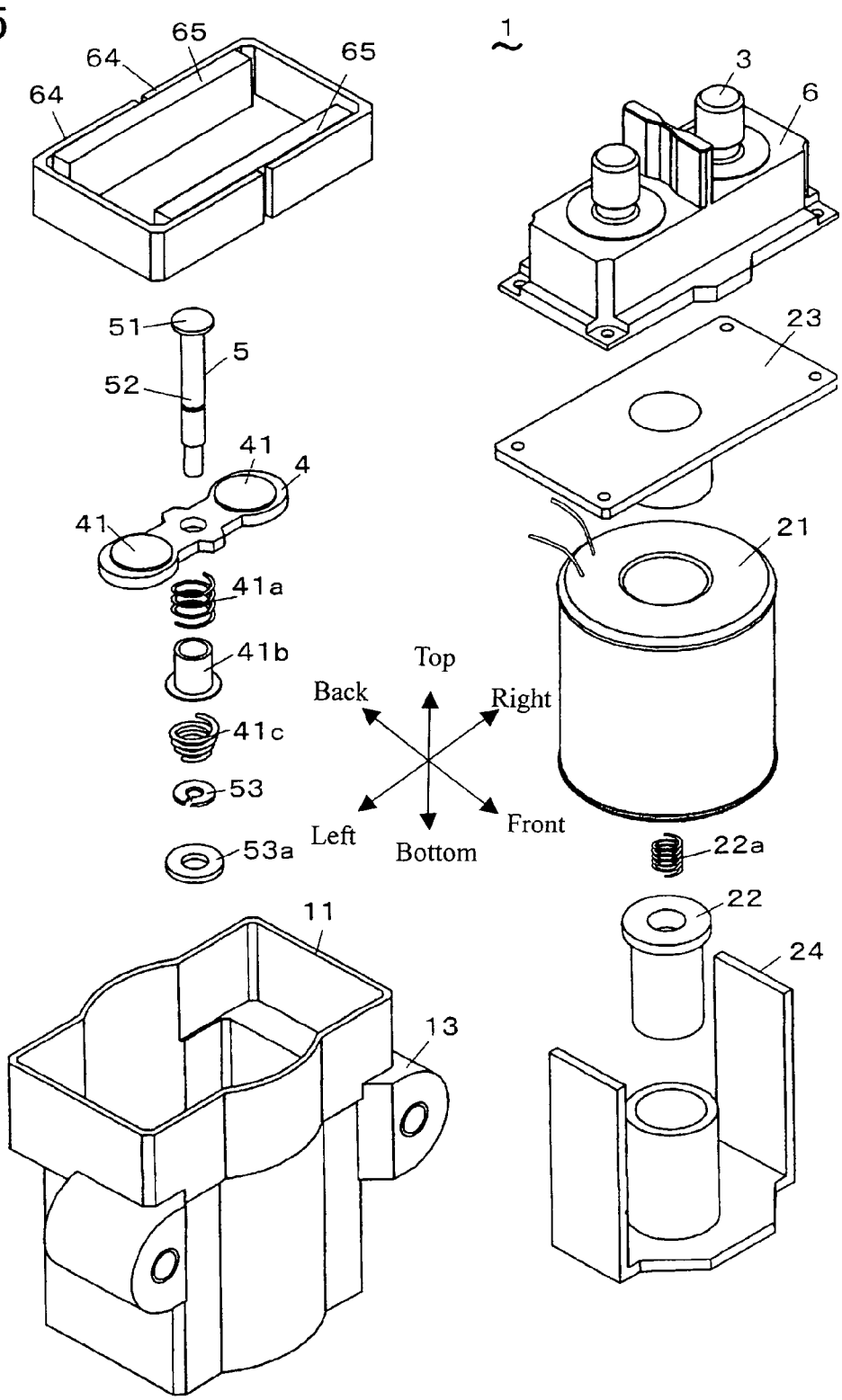
FIG. 5 Broken-down perspective view of the electromagnetic switching device
Figure 6:
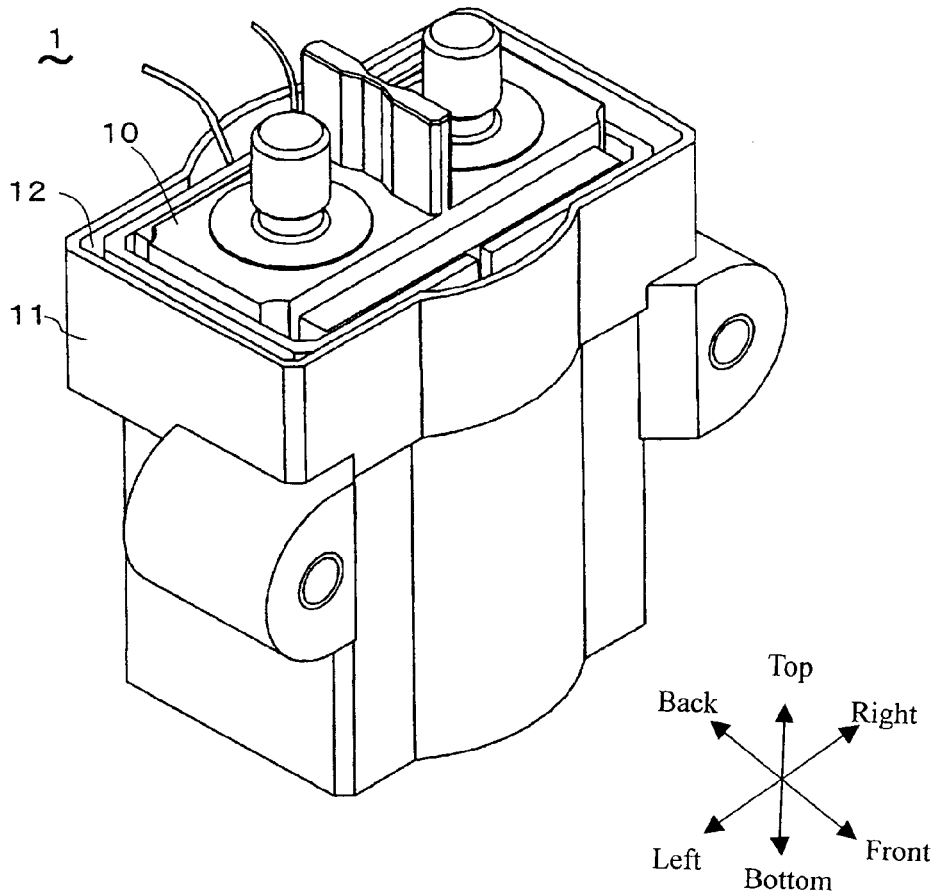
FIG. 6 Perspective view of the electromagnetic switching device without a potting process FIG. 7 Perspective view of the electromagnetic switching device FIG. 8 Cross-section view of line D—D of FIG. 1
Figure 7:
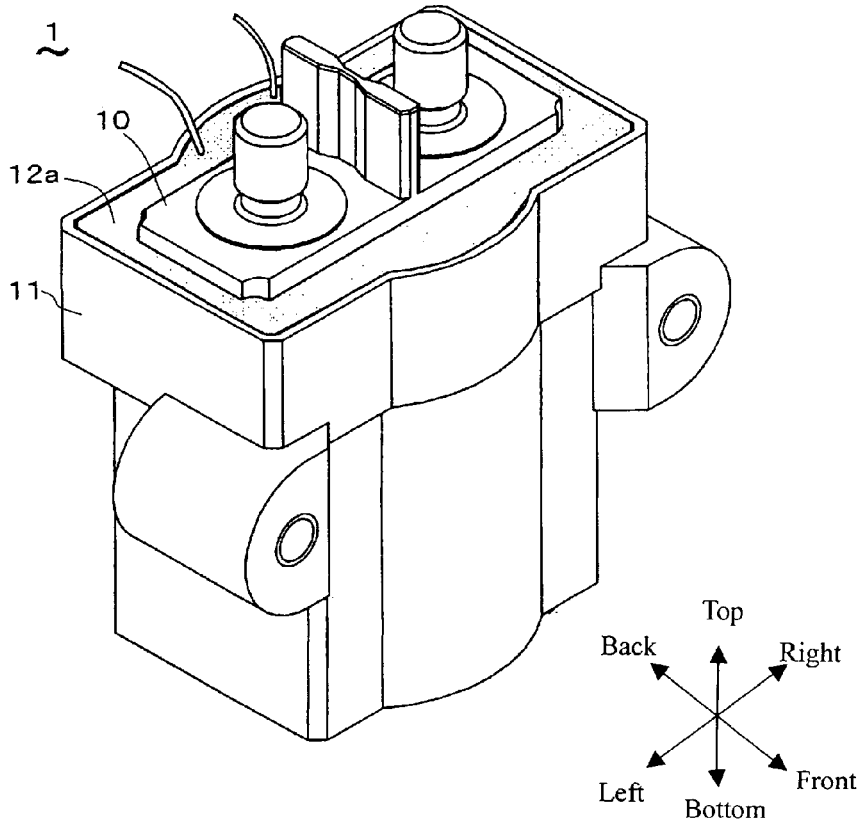

Each component in FIG. 5 mentioned above is respectively assembled by the specified procedures and becomes the main body of the electromagnetic switching device 10 as shown in FIG. 6, excepting the body 11. The main body of the electromagnetic switching device 10 is placed in the body 11, and the potting compound 12*a* is charged into the space 12 between the main body of the electromagnetic switching device 10 and the body 11 as shown in FIG. 7.

Subsequently, the following three points on the mechanism of the electromagnetic switching device I mentioned above are described accordingly: (1) the up and down movement of the movable iron core 22 and the movement of the contacting and detaching of the fixed contact points 32 and the movable contact points 41 accompanying this up and down movement, (2) the function of the quasi-hermitically sealed space 63 and the mechanism of the potting compound 12*a*, and (3) the relation between the internal measurement of the enclosing component 6 and the movable contact 4.

(1) Refer to FIGS. 1 and 3. When the electromagnetic actuator 2 is excited and the movable iron core 22 moves up, the shaft 5 and the movable terminal 4 move up together, and when the movable contact points 41 touch the fixed contact points 32, the movable contact 4 stops moving and the shaft 5 continues to move upward until the movement of the movable iron core 22 stops (overstroke.) In this state, the movable contact points 41 are press-contacted with the fixed contact points 32 by the biasing power of the contact pressure springs 41*a* and 41*b*, and the electric resistance between the contact surfaces is sufficiently reduced.

The contact pressure spring 41*a* placed on the upper part is a weak coil spring (the spring constant is low) and the contact pressure spring 41*c* placed on the lower part is a strong coil spring (the spring constant is large.) These two strong and weak coil springs are separated by the stopper 41*b*, which has a part projecting upwards, and used in series vertically. With this type of mechanism, the contact pressure spring 41*a*, which is a weak coil spring, is compressed until the projecting part on the edge of the, stopper 41*b* touches the under surface of the movable contact 4, and after the projecting part on the edge touches the movable contact 4, only the contact pressure spring 41*c*, which is a strong spring, is compressed.

In such an electromagnetic switching device 1, it is possible to restrain the occurrence of the performance trouble called hesitation that occurs when the difference between the magnetic attractive force and the spring load becomes small. In addition to this effect, it is also possible to decide the stroke of the contact pressure springs 41*a* and 41*c* by using the stopper 41*b* and to prevent the spring load from varying.

(2) Refer to FIGS. 1 and 3. The potting compound 12*a* is charged into the space between the body 11 and the main body of the electromagnetic switching device, which is the space between the body 11 and the quasi-hermitically sealed space 63. By using a material that has a good heat conductance as the potting compound 12*a*, it is possible to quickly cool down the enclosing component 6 and the first yoke 23 that are the constructional components of the quasi-hermitically sealed space heated by the arc generated between the fixed contact points 32 and the movable contact points 41. Therefore, it is possible to extinguish the arc by quickly absorbing the heat energy of the arc generated. Additionally, because the potting compound 12*a* restrains the propagation of the vibration that occurs from the main body electromagnetic switching device, which is placed inside, to the body 11, a silent effect can be obtained. By using the potting compound 12*a*, the covering component is not needed and the body 11 can be built with only one component. This enables the lowering of costs.

Figure 8:
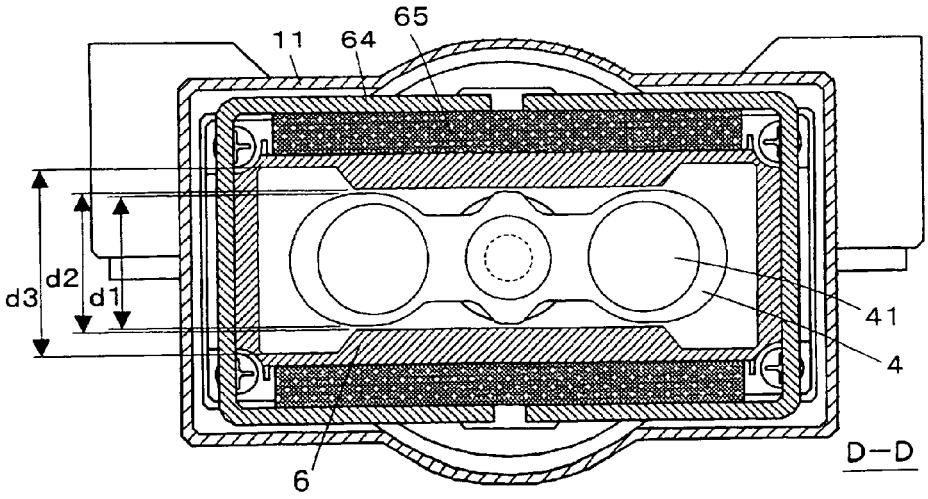

(3) Refer to FIG. 8. The inside walls of the front and back (top and bottom directions in the Figure) of the enclosing component 6 are thicker towards the inner side in the middle part, and the measurements between the inside walls are d2 for the distance of the middle part, d3 for the distance of the edge part, and the relation with d1 for the width of the front and the back of the movable contact 4 is d1≈d2<d3. When the distance between the inside walls of enclosing component 6 and the movable terminal 4 is narrow at the part that is near the shaft and wider at the part that is far from the shaft, it is possible to limit the rotational position change of the movable contact due to the spinning of the shaft, etc. that fixes the center part of the movable contact 4. Thus, the contact position of the movable contact points 41 against the fixed contact 32 can be stable, and the current control by the electromagnetic switching device 1 can be performed more stably. Subsequently, the Embodiments from 2 to 8 described below add functions to reduce the operating noise of the electromagnetic switching device to the electromagnetic switching device of Embodiment 1.

Embodiment 2

Figure 9:
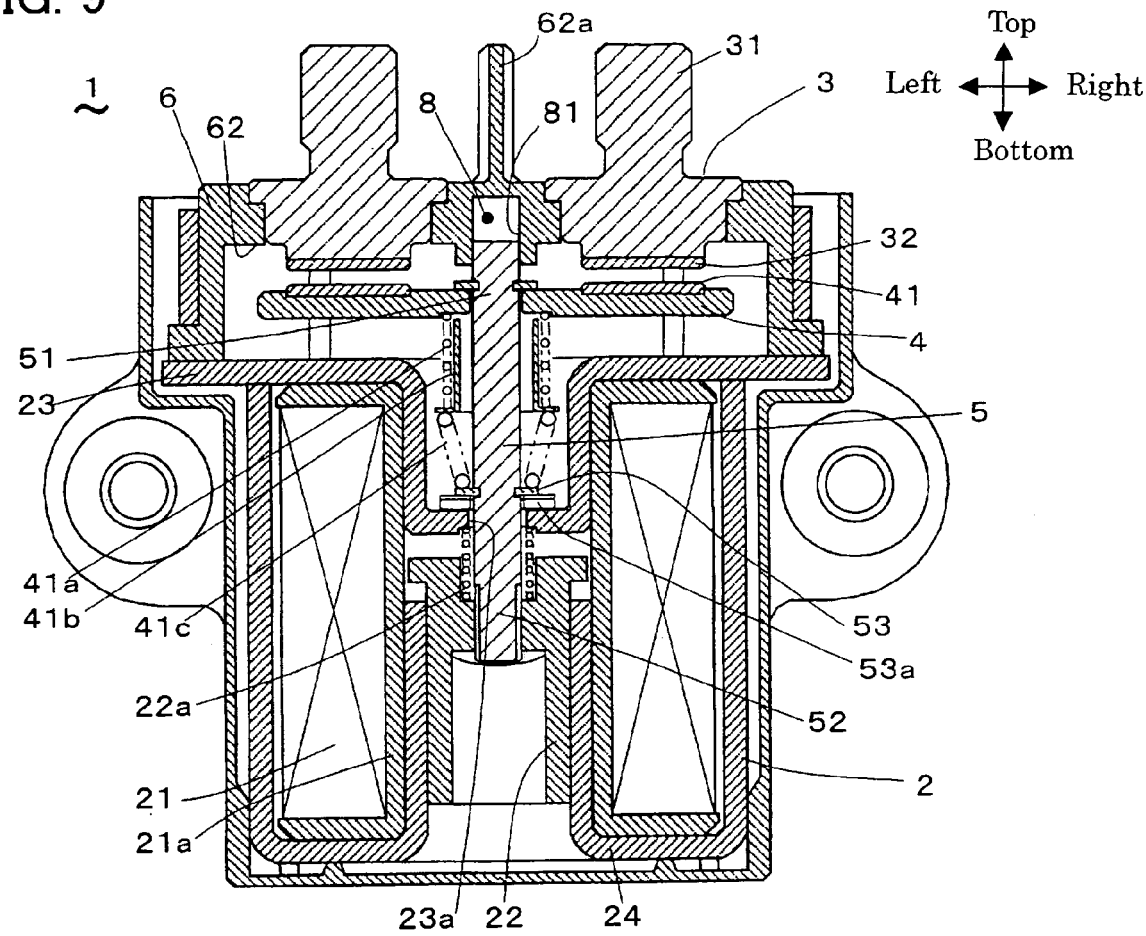
FIG. 9 Cross-section view on the plain surface indicating directions, right, left, up and bottom, of an electromagnetic switching device concerning Embodiment 2 of this invention FIG. 10 Cross-section view of the adjacent part of a recess of the electromagnetic switching device FIG. 11 Cross-section view of the adjacent part of a recess of an electromagnetic switching device concerning embodiment 3 of this invention FIG. 12 Cross-section view of the adjacent part of a recess of an electromagnetic switching device concerning Embodiment 4 of this invention FIG. 13 Cross-section view on the plain surface indicating directions, right, left, up and bottom, of an electromagnetic switching device concerning Embodiment 5 of this invention FIG. 14 Cross-section view illustrating the movement of a first yoke and a movable iron core of the electromagnetic switching device FIG. 15 Graph of the variation of the magnetic force between the first yoke and the movable iron core of the electromagnetic switching device FIG. 16 Cross-section view of the adjacent part of a recess of an electromagnetic switching device concerning Embodiment 6 of this invention FIG. 17 Outside view or partial cross-section showing the attachment of an electromagnetic switching device concerning Embodiment 7 of this invention FIG. 18 Outside view or partial cross-section showing the attachment of an electromagnetic switching device concerning Embodiment 8 of this invention FIG. 19 Cross-section view of an existing electromagnetic switching device FIG. 20 Cross-section view of line E—E of FIG. 19
Figure 10:
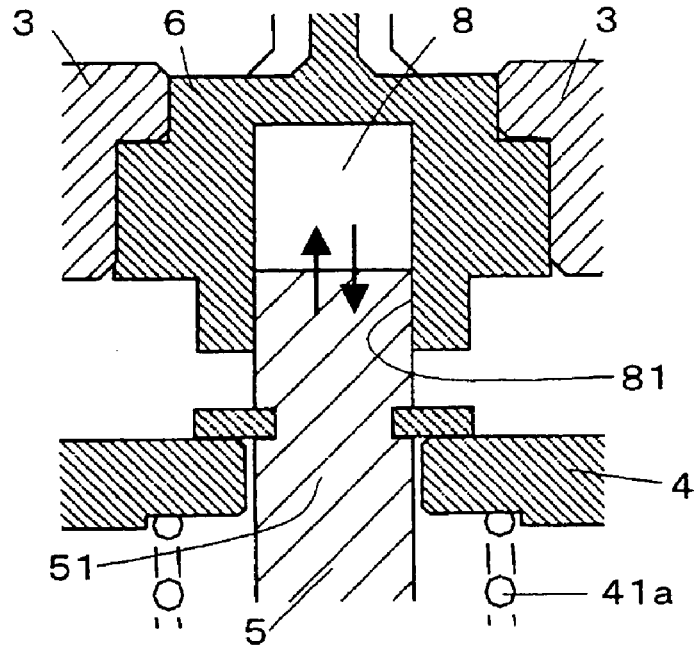

FIGS. 9 and 10 show the electromagnetic switching device 1 in Embodiment 2. This electromagnetic switching device 1 has a recess 8 with an insertion hole 81 facing downward at the center of the bottom part 62 of the enclosing component 6, and the point that the upper part of the shaft 5 is inserted and closes the inserting hole 81 is different form the electromagnetic switching device 1 in Embodiment 1 (for instance, refer to FIG. 1.) When the top part of the shaft 5 moves up and down, gas, fluids or particles that become resistant to the up and down movement of the shaft fill the recess 8.

In Embodiment 2 of this mechanism, it is possible to reduce the impact given when the movable contact points 41 contact with and detach from the fixed contact points 32 by the resistance of the gas, fluids or particles to the movement of the shaft 5, and to reduce the operating noise of the electromagnetic switching device 1. Additionally, because the resistance of the gas, fluids or particles does not work excepting when the movable contact points 41 contact with and detach from the fixed contact points 32, the excess power is not applied constantly, and there is no occurrence of performance deteriorations (side effects) such as a deterioration of the resistance to the vibration of the electromagnetic switching device 1 and an increase of the drive voltage.

As mentioned above, the reduction of the operating noise of the electromagnetic switching device 1 is achieved by appropriately restraining the movements of the shaft 5, which is the moving part that moves accompanying the movement of the movable iron core 22, the movable contact 4 and the movable iron core 22 itself (these we will name them the movable part M generically). In other words, in general, the cushioning component that restrains the movement can be placed on the movable part M. Also, the recess 8 filled with the resistive fluids (gas and fluids or the particles) realizes this cushioning part. Therefore, a cushioning part like this can be placed not only in the enclosing component 6 as above but also at the parts which restrain the movement of the movable iron core 22 at the lower part. In addition, in Embodiments 3 and 4 described below, the recess 8 is placed in the enclosing component 6.

Embodiment 3

Figure 11:
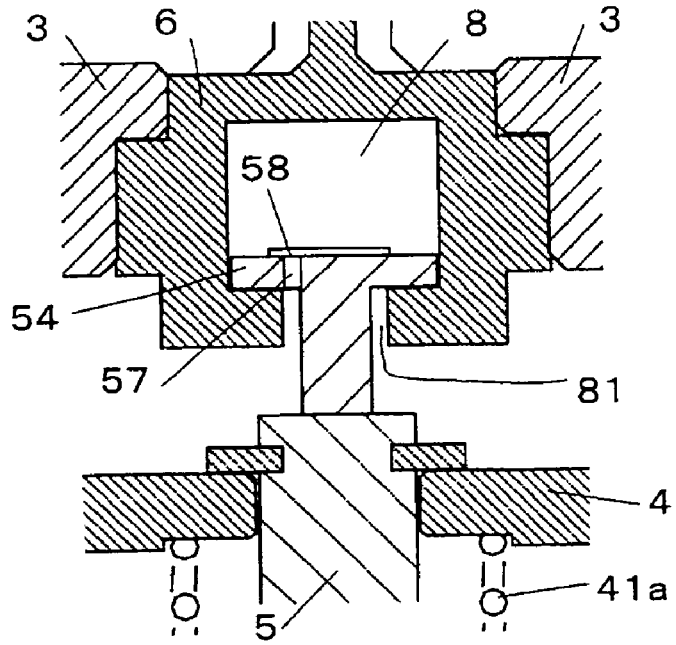

FIG. 11 shows the recess 8 of the electromagnetic switching device 1 in Embodiment 3. The electromagnetic switching device of Embodiment 3 forms the flange 54, which rubs upward and downward along the inner surface of the recess 8, on the upper end of the shaft 5, and it has a valve 58 that opens and closes the insertion hole 57 over the flange 54 as well as the insertion hole 57 on the flange 54, and the upper end of the shaft 5 including the flange 54 is inserted into the insertion hole 81 and closes the insertion hole 81, and the gas, fluids or the particles that become resistant to the movement of the shaft 5 along the axis placed vertically.

In Embodiment 7 of the mechanism mentioned above, when the shaft 5 moves upward, it is possible to reduce the moving speed of the movable contact 4 because of the resistance of the gas, fluids or the particles in the recess 8. On the other hand, when the shaft 5 moves downward, it is not possible to slow down the moving speed of the movable contact 4 because a valve 58 opens. Generally, when the movable contact 4 moves in a direction that the movable contact points detach from the fixed contact points, the moving speed is reduced, and the performance of the electromagnetic switching device 1 is reduced, but in Embodiment 3, because opening the valve 58 prevents the moving speed of the movable contact 4 from slowing down, it is possible to reduce the operating noise without deteriorating the performance of the electromagnetic switching device 1.

Embodiment 4

Figure 12:
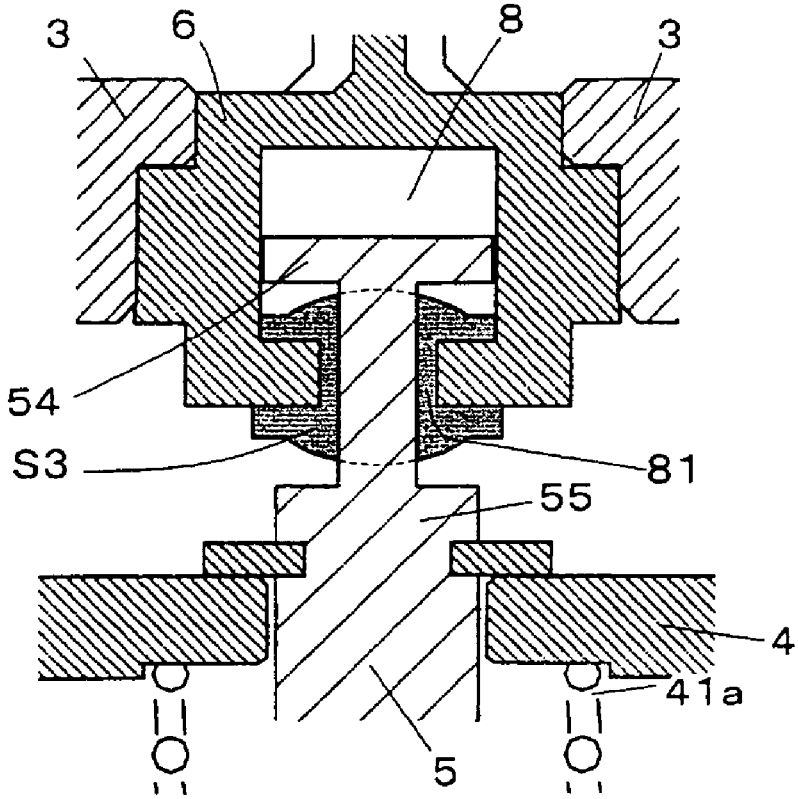

FIG. 12 shows the recess 8 of the electromagnetic switching device 1 in Embodiment 4. The electromagnetic switching device 1 of Embodiment 4 has the enclosure S3, in which fluid is enclosed, at the position where at least one of the following movable part M collides: the movable iron core 22, the shaft 5 and the movable contact 4. In the electromagnetic switching device 1 shown in FIG. 12, the torus-shaped enclosure S3 with a hole in the center is fixed in the insertion hole 81 of the recess 8, and intervenes between the insertion hole 81 and the top of the upper end of the shaft 5. And the flange 54 is placed on the edge of the shaft 5 inside the recess 8, and a flange (diameter expansion part) 55 is also placed on the shaft 5 outside the recess 8.

In Embodiment 4 of the mechanism mentioned above, because the enclosure S3 moves to the inside and the outside of the recess 61 by being pushed by the flanges 54 and 55 when the shaft 5 moves up and down, it is possible to absorb the impact generated when the movable part collides, using the viscosity of the fluid inside the enclosure S3 and also to reduce the operating noise.

Embodiment 5

Figure 13:
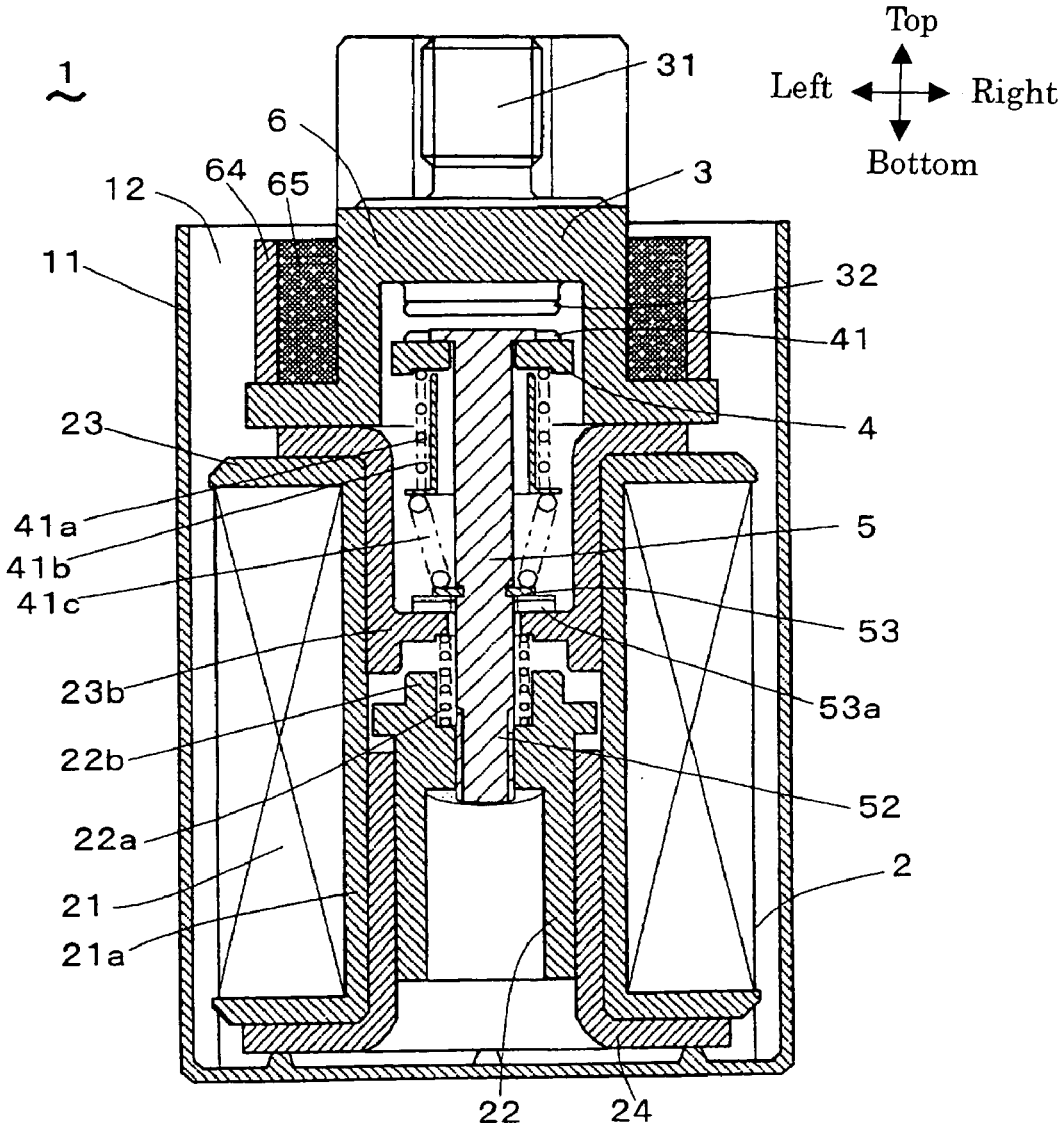
Figure 14:
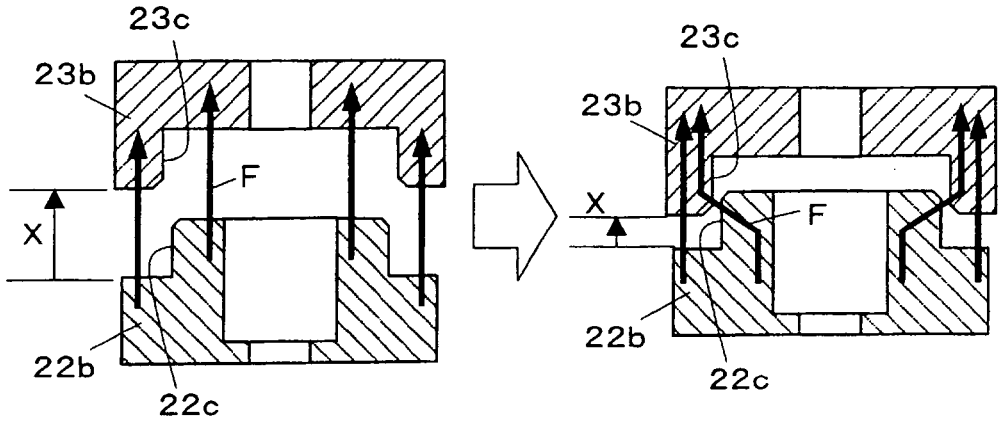
Figure 15:
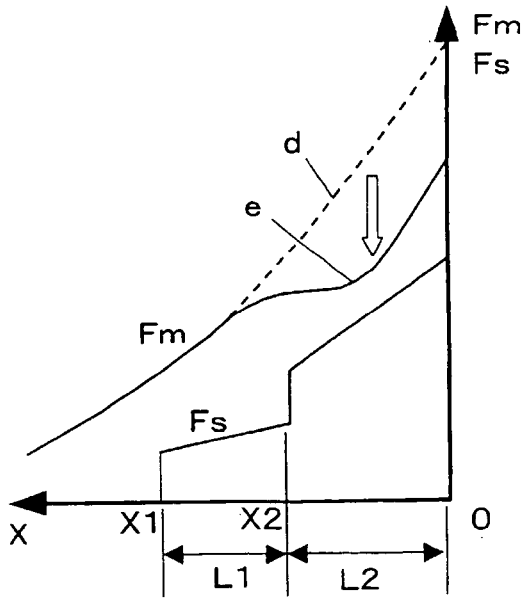

FIGS. 13, 14 and 15 show the cross-section surface of the electromagnetic switching device 1, the mechanism of the magnetic poles, facing each other, of the first yoke 23 and the movable iron core 22 of the electromagnetic switching device 1, and the change of the magnetic power between the magnetic poles, respectively in Embodiment 5. The electromagnetic switching device 1 of Embodiment 5 has a gap that has a quasi-connection on the respective facing surfaces of the first yoke 23 and the movable iron core 22, in other words, it has a concave part 23*c* on the first yoke 23 and a convex part 22*c* on the movable iron core 22. Additionally, the side of the concavoconvex gap can also be a taper-shaped surface, not only the vertical surface shown in FIG. 14.

In Embodiment 5 of the mechanism mentioned above, the reduction of the magnetic attractive force, which is generated when the magnetic flux F deviates from the direction of the movement of the movable iron core 22, is used when the mutual distance X of each facing surface of the magnetic poles changes from the situation whereby the mutual distance X is wider than the gap as shown in the left side of FIG. 14 to the situation whereby the mutual distance X is narrower than the height of the gap and interdigitates mutually shown in the right side of FIG. 14.

Refer to FIG. 15 for the explanation. The X-axis shows the moving distance of the movable iron core 22 (the downward direction is positive in FIG. 13.), and the vertical axis shows the spring load Fs (spring biasing power) and the magnetic attractive force Fm. The spring load Fs biases the movable iron core 22 to the positive direction of X and the magnetic attractive force Fm biases to the negative direction of X. X=0 is the point where the movable iron core 22 reaches the movement limit (the highest point) by the magnetic absorption. X=X1 is the point where the movable iron core 22 returns to the maximum (the lowest point) by the coil spring 22*a* because of the excitation by the electromagnetic actuator being stopped. X=X2 is the point where the fixed contact points and the movable contact points contact and detach.

The distance L1 is the distance between the contact points, and the distance L2 is the distance of the overstroke, in other words, it is the distance to give the biasing power, which is caused by the contact pressure springs 41*a* and 41*b* because of the shaft 5 rising even after the contact points contact with each other, to the distance between the contact points. To the spring load Fs, only the coil spring 22*a* contributes in the interval of X1–X2 and the contribution of the contact pressure springs 41*a* and 41*b* is added as well as the contribution of the coil spring 22*a* in the interval of X2–0.

When a magnetic attractive force Fm that is larger than the spring load Fs is generated by the electromagnetic actuator being excited, the movable iron core 22 moves from X=X1 to X2, and the magnetic attractive force Fm increases accompanying the approach between the magnetic poles. The movable iron core 22 moves further to X=0 because of the increase of the magnetic attractive force Fm that exceeds the increase of the spring load Fs. When the surface of the magnetic pole end is the normal shape (Embodiment 1), the magnetic attractive force Fm changes like the curve line d, but in the case of Embodiment 5, the attractive force decreases immediately before the movable iron core 22 colliding with the first yoke 23 like the curve line e because of the gap effect as mentioned above. With this, it is possible to absorb the impact generated when the movable contact points 41 collide with the fixed contact points 32 and to reduce the operating noise of the electromagnetic switching device 1.

Embodiment 6

Figure 16:
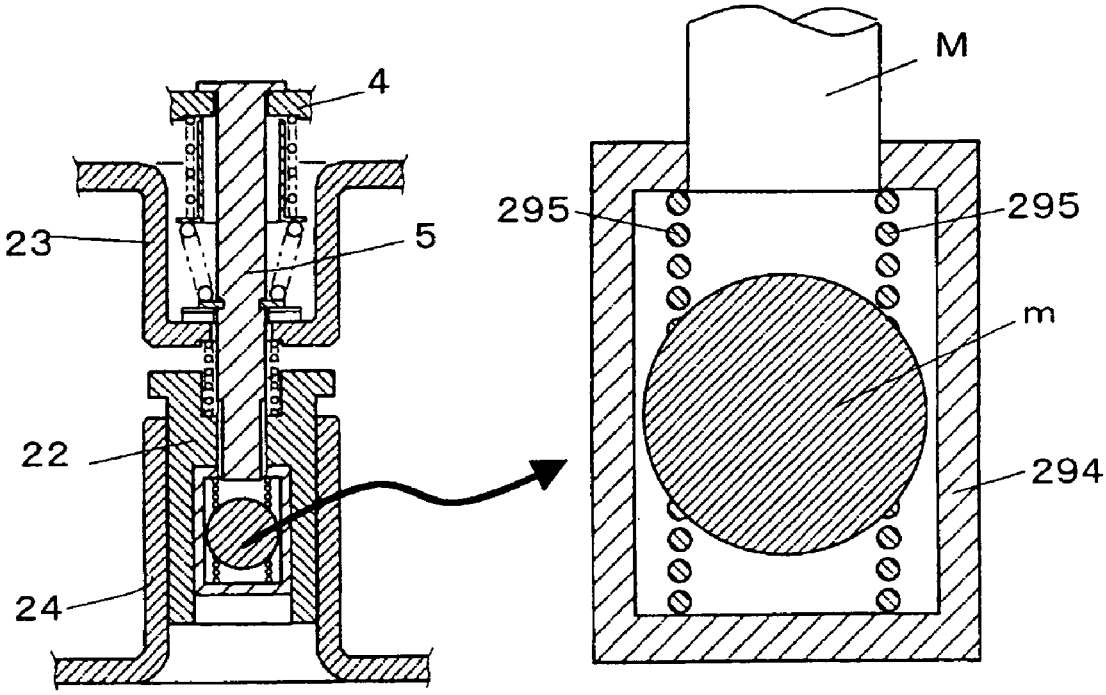

FIG. 16 shows the surrounding part of the movable iron core 22 of the electromagnetic switching device 1 in Embodiment 6. The electromagnetic switching device 1 in Embodiment 6 is built by adding a mass body (a weight) m, which vibrates along the moving direction of the movable part M by the elastic deformation, to at least one of the movable part M, which includes the movable iron core 22, the shaft 5 and the movable contact 4. FIG. 16 shows the state that the storage frame 294, which contains the mass body m locked by the coil spring 295, is attached to the shaft 5 as the movable part M.

When the mass of the movable part M is designated as M, the mass of the mass body m is designated as m, and the mass body is rigidly fixed to the movable part M, the movable part M with the mass body m collide keeping the kinetic energy E1=½×(M+m)×V×V that is the basis of the speed V before the collision at the time of the movable contact points 41 and the fixed contact points 32 colliding. However, in this Embodiment 6, because the mass body m that is vibratile and is fixed to the movable part M continues to move with the kinetic energy of ½×m×V×V after the collision, the vibration energy consumed by the collision is reduced from E1 to E2=½×M×V×V. Because of this, it is possible to reduce the operating noise when the electromagnetic switching device drives.

Embodiment 7

Figure 17:
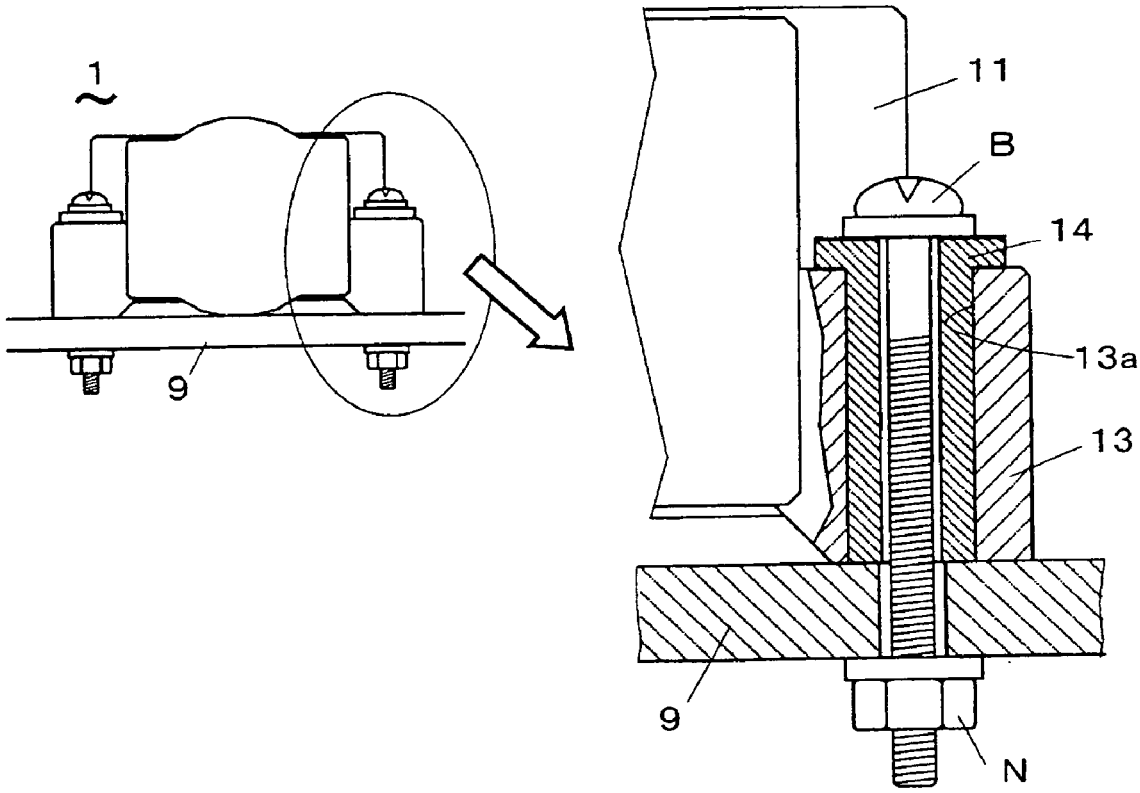

FIG. 17 shows the condition of attaching the electromagnetic switching device 1 to the external mountings in Embodiment 7. The electromagnetic switching device 1 in Embodiment 7, for example, is attached to an attaching part 9 such as a mounting plate of an electric vehicle through the mountings 13 that have the insertion holes 13*a* formed on the body 11. At this time, the pipes 14, which are made of high damping steel, are formed into a cylinder, and have the flange facing out on one of the ends, are inserted into the insertion holes 13*a*, and with the pipes 14 intervening, the volt B, which is the fixing component, is inserted into the insertion holes 13*a* on the mountings 13, and the body 11 is fixed to the attaching part 9 using the nut N, which is one of other fixing components. In Embodiment 7, because it is possible to reduce the vibration that propagates from the electromagnetic switching device 1 to the attaching part 9, the operating noise of the electromagnetic switching device 1 can be reduced.

Embodiment 8

Figure 18:
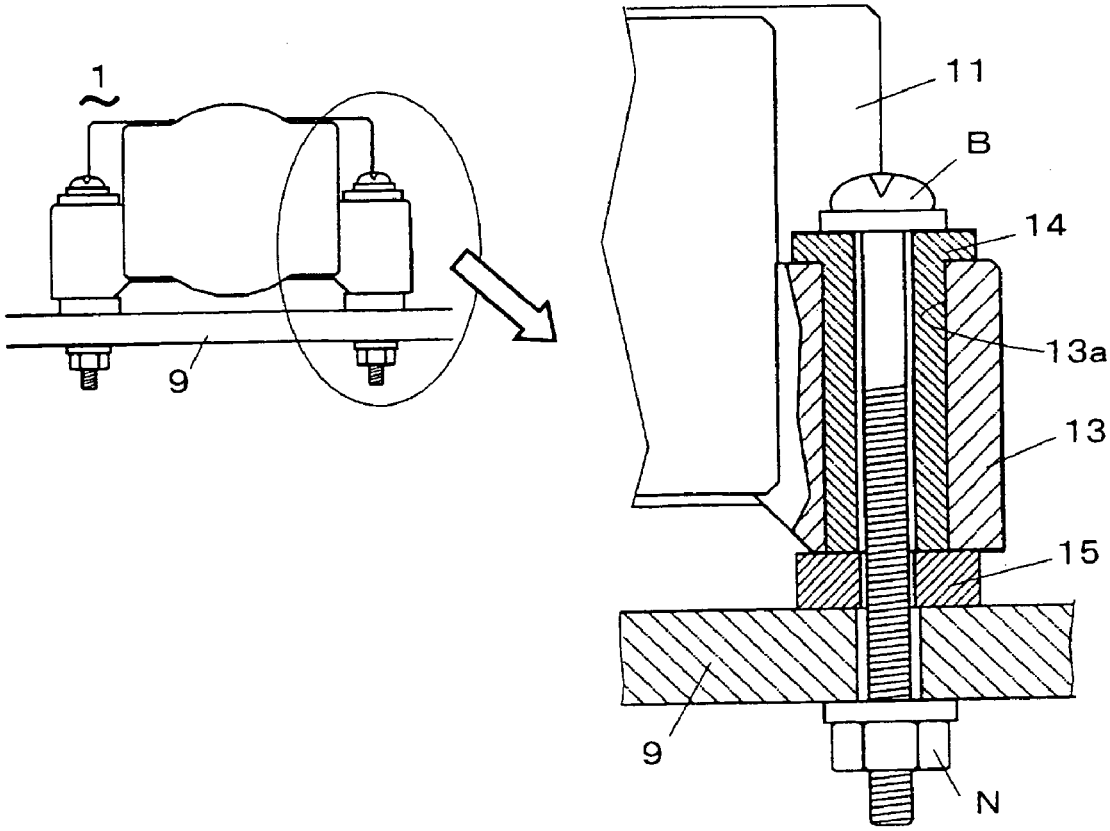
Figure 19:
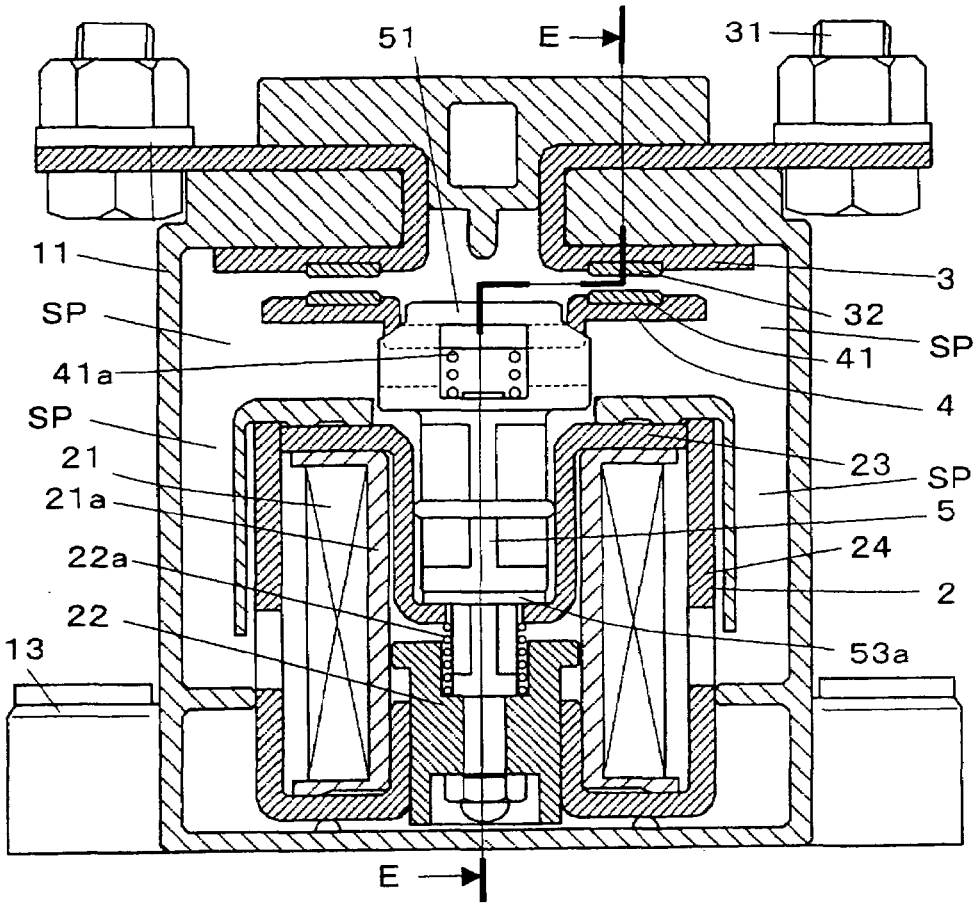
Figure 20:
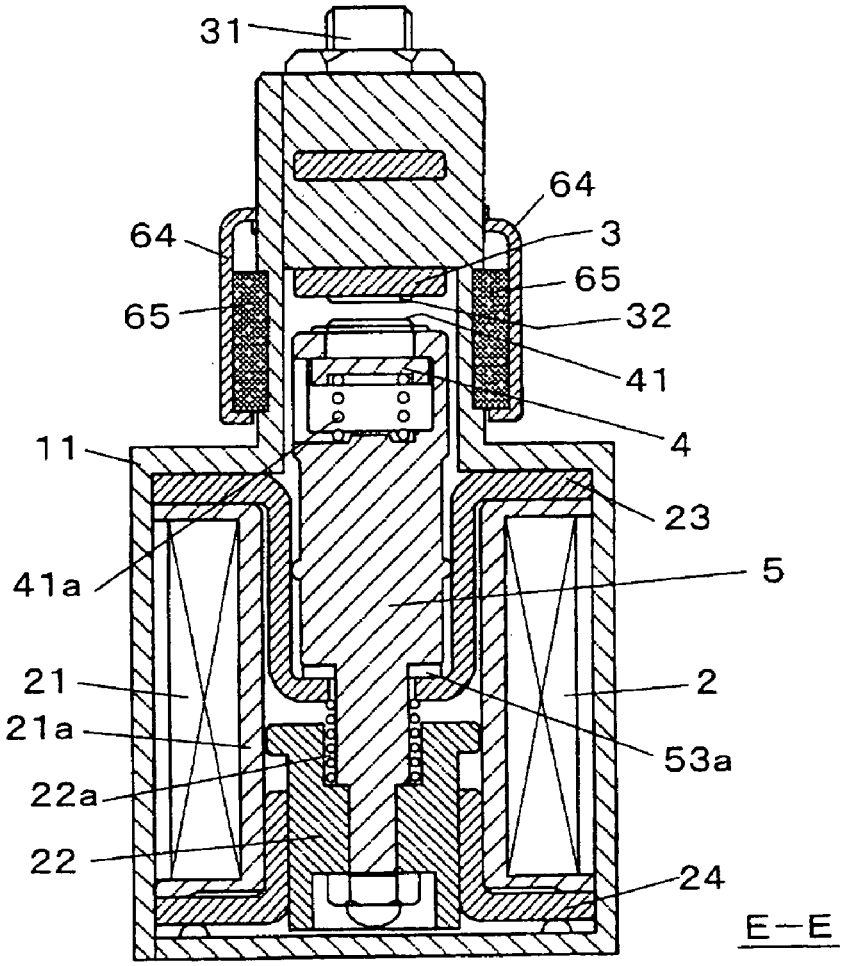
Figure 21:
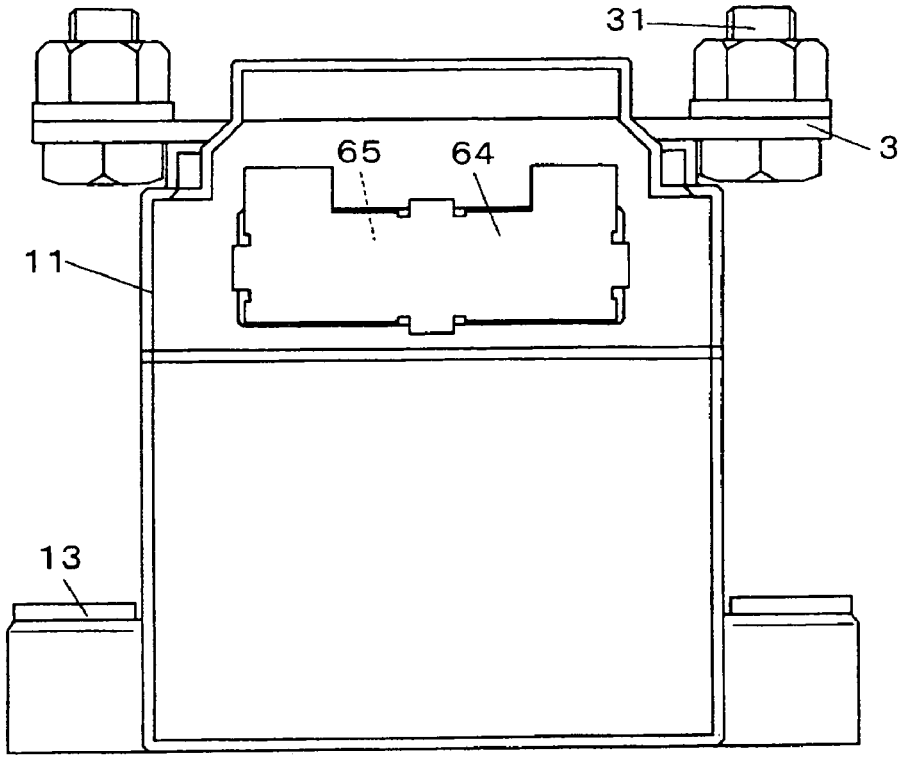
FIG. 21 Side view of the electromagnetic switching device

FIG. 18 shows the condition of attaching the electromagnetic switching device 1 to the external mountings in Embodiment 8. The electromagnetic switching device 1 in Embodiment 8, for example, is attached to the attaching part 9 such as a mounting plate of an electric vehicle through the mountings 13 that have the insertion holes 13*a* formed on the body 11 in a same way as Embodiment 7. At this time, on the attaching side of the mountings 13, the flexible ring-shaped component 15 that encloses the magnetic fluids, MR fluid or ER fluid is placed, and with the ring-shaped component 15 intervening, the volt B, which is the fixing component, is inserted into the insertion holes 13*a* or the ring-shaped component 15 on the mountings 13, and the body 11 is fixed to the mountings 9 using the nut N, which is one of other fixing components.

When the fluid enclosed is the magnetic fluid or MR fluid, the ring-shaped component 15 becomes hard by the magnetic field at the time of the electromagnetic actuator 2 being energized, and becomes softer at the time of the electromagnetic actuator 2 being not energized than at the time of the electromagnetic actuator 2 being energized. Also, when the fluid enclosed is ER fluid, the ring-shaped component 15 becomes harder at the time of the electromagnetic actuator 2 being energized than at the time of the electromagnetic actuator 2 being not energized because the voltage is applied to ER fluid. And when the electromagnetic actuator 2 is not energized and the voltage applied to ER fluid is removed, it becomes softer than when the electromagnetic actuator 2 is energized.

In Embodiment 8 as above, it is possible to reduce the operation noise by having the ring-shaped component 15. Also, because it is possible to make the ring-shaped component 15 harder when the electromagnetic actuator 2 is energized, and softer when the electromagnetic actuator 2 is not energized, it is suitable for electric vehicles. In other words, because the electric vehicle is stopped and the ring-shaped component 15 is softer before the movable contact points 41 contact with the fixed contact points 32, it is possible to restrain the propagation of the vibration to the attaching part 9 of the electric vehicle when the movable contact points 41 contact with the fixed contact points 32. Additionally, it is possible to prevent the resonance by fixing the electromagnetic switching device 1 tightly to the attaching part 9 while the vehicle is moving, and the ring-shaped component 15 becomes softer after the movable contact points 41 separate from the fixed contact 32 points. Therefore, it is possible to restrain the propagation of the vibration to the attaching part 9.

This application claims a priority based on the Japanese Patent Application No. 2003-270346 of Jul. 2, 2003. The entire content of the application is incorporated herein by reference.

What is claimed is:

1. An electromagnetic switching device, comprising:

an electromagnetic actuator, comprising a solenoid coil, a movable iron core, a first yoke disposed at one end of the solenoid coil and comprising an insertion hole, and a second yoke disposed at another end of the solenoid coil;

a pair of fixed terminals, each of which has a fixed contact point at one end thereof and a terminal area connected to an external circuit at another end thereof;

a movable contact, comprising a pair of movable contact points that contact and separate from the fixed contact points;

first and second springs disposed between the movable contact and the first yoke, one of the first and second springs being stronger than another of the first and second springs;

a shaft, comprising a retentive part at one end thereof that retains the movable contact, the shaft being inserted through the insertion hole of the first yoke and being fixed to the movable iron core at another end thereof; and an enclosure which encloses the movable contact points and the fixed contact points, wherein the pair of movable contact points contact and separate from the fixed contact points by movement of the shaft by moving the movable iron core along an axis of the electromagnetic actuator, and the movable contact points and the fixed contact points are disposed in a substantially sealed space formed between the enclosure and the first yoke.

2. The electromagnetic switching device according to claim 1, further comprising a body which surrounds the electromagnetic actuator and the enclosure, and a potting compound which fills a space between the body and the enclosure.

3. The electromagnetic switching device according to claim 1, wherein a width of a central portion of the enclosure is narrower than a width of outer portions of the enclosure.

4. The electromagnetic switching device according to claim 1, wherein a recess is formed on an underside of the enclosure, a flange is formed on an end of the shaft and inserts into the recess, an insertion hole is formed in the flange, a valve opens and closes the insertion hole formed in the flange, and the recess is filled with one of a gas, a liquid and particles which provide resistance against movement of the shaft.

5. The electromagnetic switching device according to claim 1, further comprising a mass, provided in the movable iron core, which vibrates in a direction of the axis of the electromagnetic actuator to reduce vibration of the movable iron core.

6. The electromagnetic switching device according to claim 1, wherein a gap is formed between the first yoke and the movable iron core.

7. The electromagnetic switching device according to claim 1, further comprising an enclosure containing a fluid, which is provided at one of an end of the movable iron core, an end of the shaft, and an end of the movable contact.

8. The electromagnetic switching device according to claim 1, further comprising a body having insertion holes that receive pipes made of a high damping steel, the pipes receiving a fixing component that attaches the body to an external mounting.

9. The electromagnetic switching device according to claim 8, further comprising flexible ring-shaped enclosures containing one of a magnetic fluid, an MR fluid, and an ER fluid, which are provided between the body and the external mounting.

10. An electromagnetic switching device, comprising:

an electromagnetic actuator, comprising a solenoid coil, a movable iron core, a first yoke disposed at one end of the solenoid coil and comprising an insertion hole, and a second yoke disposed at another end of the solenoid coil;

a pair of fixed terminals, each of which has a fixed contact point at one end thereof and a terminal area connected to an external circuit at another end thereof;

a movable contact, comprising a pair of movable contact points that contact and separate from the fixed contact points;

a shaft, comprising a retentive part at one end thereof that retains the movable contact, the shaft being inserted through the insertion hole of the first yoke and being fixed to the movable iron core at another end thereof;

an enclosure which encloses the movable contact points and the fixed contact points;

a body which surrounds the electromagnetic actuator and the enclosure; and a potting compound which fills a space between the body and the enclosure, wherein the pair of movable contact points contact and separate from the fixed contact points by movement of the shaft by moving the movable iron core along an axis of the electromagnetic actuator, and the movable contact points and the fixed contact points are disposed in a substantially sealed space formed between the enclosure and the first yoke.

11. The electromagnetic switching device according to claim 10, wherein a width of a central portion of the enclosure is narrower than a width of outer portions of the enclosure.

12. The electromagnetic switching device according to claim 10, wherein a recess is formed on an underside of the enclosure, a flange is formed on an end of the shaft and inserts into the recess, an insertion hole is formed in the flange, a valve opens and closes the insertion hole formed in the flange, and the recess is filled with one of a gas, a liquid and particles which provide resistance against a movement of the shaft.

13. The electromagnetic switching device according to claim 10, further comprising a mass, provided in the movable iron core, which vibrates in a direction of the axis of the electromagnetic actuator to reduce a vibration of the movable iron core.

14. The electromagnetic switching device according to claim 10, wherein a gap is formed between the first yoke and the movable iron core.

15. The electromagnetic switching device according to claim 10, further comprising an enclosure containing a fluid, which is provided at one of an end of the movable iron core, an end of the shaft, and an end of the movable contact.

16. The electromagnetic switching device according to claim 10, wherein the body comprises insertion holes that receive pipes made of a high damping steel, the pipes receiving a fixing component that attaches the body to an external mounting.

17. The electromagnetic switching device according to claim 16, further comprising flexible ring-shaped enclosures containing one of a magnetic fluid, an MR fluid, and an ER fluid, which are provided between the body and the external mounting.

* * * * *

UNITED STATES PATENT AND TRADEMARK OFFICE

CERTIFICATE OF CORRECTION

PATENT NO. : 7,157,996 B2
APPLICATION NO. : 10/535337
DATED : January 2, 2007
INVENTOR(S) : H. Enemoto et al.

It is certified that error appears in the above-identified patent and that said Letters Patent is hereby corrected as shown below:

On the cover page, Item (56), References cited, Foreign Patent Documents, "2002-042626" should be --2002-042628--.

Signed and Sealed this

Twenty-seventh Day of May, 2008

JON W. DUDAS
*Director of the United States Patent and Trademark Office*